US008341909B2

(12) United States Patent
Sondermann

(10) Patent No.: US 8,341,909 B2
(45) Date of Patent: Jan. 1, 2013

(54) PROFILED RAIL SYSTEM

(75) Inventor: Frank Sondermann, Drolshagen (DE)

(73) Assignee: Herm. Friedr. Kuenne GmbH & Co., Luedenscheid (DE)

( * ) Notice: Subject to any disclaimer, the term of this patent is extended or adjusted under 35 U.S.C. 154(b) by 19 days.

(21) Appl. No.: 12/315,033

(22) Filed: Nov. 26, 2008

(65) Prior Publication Data

US 2009/0133349 A1 May 28, 2009

(30) Foreign Application Priority Data

Nov. 26, 2007 (DE) ..... 20 2007 016 585 U

(51) Int. Cl.
*E04F 15/14* (2006.01)

(52) U.S. Cl. ..... 52/396.04; 52/395; 52/584.1; 52/466

(58) Field of Classification Search ..... 52/177, 52/394, 395, 459, 460, 461, 463, 464, 466, 52/468, 718.04, 396.04, 396.1, 584.1; 16/7, 16/16

See application file for complete search history.

(56) References Cited

U.S. PATENT DOCUMENTS

| | | | | |
|---|---|---|---|---|
| 3,183,626 | A * | 5/1965 | Schmitt | 52/395 |
| 3,417,528 | A * | 12/1968 | Hallock | 52/367 |
| 3,659,390 | A * | 5/1972 | Balzer et al. | 52/464 |
| 5,384,996 | A | 1/1995 | Nicholas | |
| 7,150,134 | B2 * | 12/2006 | Kornfalt et al. | 52/416 |
| 7,287,357 | B2 * | 10/2007 | Gomez Insa | 52/464 |
| 2002/0059764 | A1 | 5/2002 | Schluter | |
| 2005/0039409 | A1 * | 2/2005 | Sondermann | 52/179 |
| 2007/0107344 | A1 * | 5/2007 | Kornfalt et al. | 52/395 |
| 2007/0137129 | A1 | 6/2007 | Sondermann | |
| 2008/0034696 | A1 * | 2/2008 | Neuhofer | 52/466 |
| 2009/0217611 | A1 | 9/2009 | Schrader | |

FOREIGN PATENT DOCUMENTS

| | | |
|---|---|---|
| DE | 34 45 071 A1 | 6/1986 |
| DE | 20 2005 020074 U1 | 4/2006 |
| EP | 1 199 424 | 4/2002 |
| WO | WO 2007/016978 | 2/2007 |

* cited by examiner

*Primary Examiner* — Robert Canfield
*Assistant Examiner* — Jessie Fonseca
(74) *Attorney, Agent, or Firm* — Epstein Drangel LLP; Robert L. Epstein

(57) ABSTRACT

The Profiled rail system (1) serves for bridging expansion joints, cavities and as an edging of floor coverings (3). System (1) has at least one web (9) aligned substantially parallel to the floor covering (3), which web (9) engages displaceably in a pocket (10). Pocket (10) is formed by a cover plate (13) overlapping the web (9) and a base plate (14) under the web (9). Pocket (10) is configured in at least two parts (11, 12). The first part (11) forms cover plate (13). The second part (12) forms base plate (14). The first part (11) and the second part (12) are held together. In a first embodiment, a undercut web (20) holds the parts together by a click connection. In a second embodiment, the parts are held together by at least one screw (18).

4 Claims, 2 Drawing Sheets

PROFILED RAIL SYSTEM

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The invention relates to a profiled rail system for bridging expansion joints, cavities and/or as the edging of floor coverings.

2. Description of Prior Art Including Information Disclosed Under 37 CFR 1.97 and 1.98

From DE 20 2005 020 074 A1, a profiled rail system of the generic type is known. It essentially consists of two profiles, into which floor covering elements can be clicked in place on the end side. Both profiles are mutually telescopable. For this purpose, one of the profiles has a web aligned parallel to the floor covering, which web engages in a pocket of the opposite profile. This profiled rail system has proved itself in practice and forms the basis for the present invention.

BRIEF SUMMARY OF THE INVENTION

The invention is based on the object to provide a profiled rail system of the type stated in the introduction, which is distinguished by a wide applicability.

This object is achieved according to the invention, by means of the following features.

The profiled rail system in accordance with the invention is used to bridge expansion joints, cavities and/or as the edging of floor coverings. Particularly in floor coverings made of natural materials such as wood, consideration must be given to an expansion and shrinkage of the floor covering. For this purpose, expansion joints are left between the floor coverings. Moreover, for the same reason, the floor coverings are distanced from the walls in order, here too, to realize expansion joints. For this purpose, the profiled rail system has at least one web aligned substantially parallel to the floor covering, which web engages displaceably in a pocket. In this way, the profiled rail system is telescopable and can thus be adjusted to the expansions and shrinkages of the floor covering. In order to obtain a wide applicability for this profiled rail system, it is desirable to obtain as great a telescopability as possible. For this, the web would need to be shaped correspondingly long and the pocket correspondingly deep to allow even wide expansion joints and cavities to be reliably covered. Since these profiled rails are generally extruded, it is not however possible to produce a deep and flat pocket with the necessary dimensional accuracy. In order to solve this problem, the pocket of the profiled rail system is configured in two parts. The pocket consists, on the one hand, of a cover plate overlapping the web and, on the other hand, of a base plate underlapping the web. It is here envisaged that the cover plate is provided in a first part and the base plate in a second part. A deep recess in the profiled rail is thus no longer necessary, with the result that this can be very easily moulded. In this way, the depth of the pocket is basically unlimited. In order to hold the two parts securely together, holding means are provided, which join the two parts together.

A simple and, at the same time, effective configuration of the holding means, is obtained in the form of at least one undercut web. The two parts can thereby be clicked one into the other, which considerably simplifies the complexity of assembly of both parts. Preferably, the web is of flexurally elastic configuration, in order to allow both parts to be easily clicked one into the other.

Alternatively or additionally the holding means are formed by at least one screw. This ensures a simple fitting together of the parts. As a result of the releasable holding means, moreover, the pocket is easily accessible to allow easy removal, for example, of foreign bodies which have got into the pocket.

In order to be able easily to fix the screws, it is favourable if, on at least one of the parts, a driving channel is formed. This driving channel supports the screws, so that a secure connection of both parts one to another is thereby ensured. The driving channel can likewise be easily produced by extrusion methods, without the need for further finishing work. The driving channel is preferably configured as a threaded driving channel in order to give a secure holding of the screw. Alternatively or in addition, the screw can also be configured as a self-cutting screw. In this way, the holding of the screw in the driving channel can be improved, or the shaping of the driving channel can be simplified.

It is favourable if the driving channel is provided in the first part. In this way, the fitting of the screws is realized from the base plate, so that the screw heads, in the assembled state of the profiled rail system, are not visible.

In order to obtain a wide adaptability of the profiled rail system even with thin floor coverings, it is favourable if the pocket has a depth corresponding to at least three times the width of the pocket. As a result of the prescribed measures, the profiled rail system can nevertheless be produced without difficulty by extrusion methods, thereby allowing a cost-effective production.

The pocket preferably has a depth corresponding to at least four times the width of the pocket. In this way, the expansion of even large-area laminate floors can be compensated without difficulty, so that, all in all, a very wide applicability of the profiled rail system is obtained.

It is advantageous if the floor covering is formed from floor covering elements, which can be held together in a click-in manner by undercut tongue and groove profilings. This produces a low complexity of assembly for laying of a floor covering. In order also to keep the complexity of laying the profiled rail system as low as possible, this is provided with undercut tongue and groove profilings to fit the floor covering elements. In these profilings, the floor coverings can be clicked appropriately in place. The mounting of the profiled rail system on the floor covering elements is here effected directly on the end face, so that an overlapping of the floor covering by the profiled rail system is not necessary. A continuous covering is thereby obtained, which, even in the region of the expansion joint, has a sufficiently firm connection. For the assembly of the profiled rail system, the profiled rails and/or the floor covering elements are tilted slightly and then the tongue is forced into the opposite groove. The assembly of the profiled rail system is essentially no different from the laying of the floor covering elements. This makes the laying of the total floor covering considerably easier and can thus be carried out without difficulty even by untrained persons. In particular, the need to align the profiled rail system to the expansion joint is eliminated. As a result of the click connection between the floor covering elements and the profiled rail, a correct mutual alignment of the two parts is automatically obtained. The fact that the floor covering elements are not overlapped by the profiled rail system also reduces the risk of tripping.

In order to eliminate the tripping risk stemming from the profiled rail system, it is favourable if at least one of the profiled rails, on the top side, lies roughly flush with the adjacent floor covering element. In particular, it is envisaged to configure the profiled rail system in such a way that it nowhere juts over the floor covering. Tripping on these profiled rails is thereby precluded.

Further advantages and features of the present invention are presented in the following detailed description with reference to the accompanying figure which contains an exemplary embodiment of the present invention. It should be understood, however, that the drawing serves merely for the purpose of illustrating the invention and does not restrict the scope of protection of the invention.

BRIEF DESCRIPTION OF THE DRAWINGS

To these and to such other objects that may hereinafter appears, the present invention relates to a heating apparatus as described in detail in the following specification and recited in the annexed claims, taken together with the accompanying drawing in which shows:

DETAILED DESCRIPTION OF THE INVENTION

Figure 1:
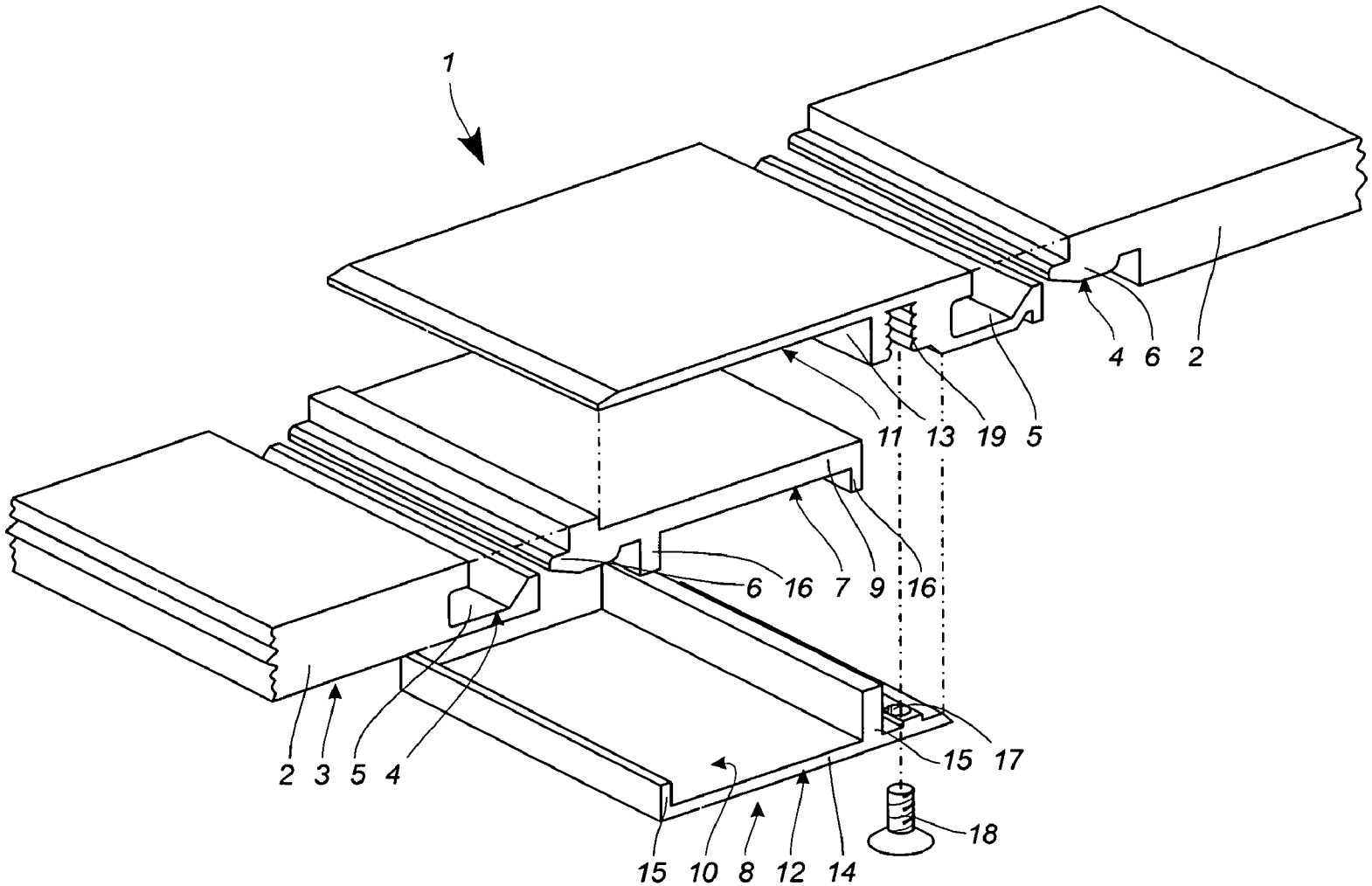
FIG. 1 shows a perspective exploded representation of a first embodiment of a profiled rail system.

FIG. 1 shows a perspective exploded representation of a first embodiment of a profiled rail system 1 having adjacent floor covering elements 2, which form a floor covering 3.

The floor covering element 2 has on the end face a tongue and groove profiling 4, which is formed, on the one hand, by an undercut groove 5 and, on the other hand, by an undercut tongue 6. By slightly angling a floor covering element 2, and then inserting the tongue 6 into the groove 5 and tilting the angled floor covering element 2 back into the horizontal position, the individual floor covering elements 2 can be clicked together. This allows particularly simple assembly of the floor covering 3, so that this can be laid even by untrained persons.

The profiled rail system 1 has respectively on the end face a groove 5 and tongue 6, which are shaped in accordance with the grooves 5 and tongues 6 of the floor covering elements 2. In this way, the profiled rail system 1 can be clicked together in the same way as the floor covering elements 2.

In order to obtain a desired length compensation of the profiled rail system 1, this is configured such that it is telescopable. The profiled rail system 1 consists of a one-part web part 7 and a two-part pocket part 8. The web part 7 has a web 9, which extends substantially parallel to the floor covering 3, i.e. in the horizontal direction. This web 9 engages in a pocket 10 configured in the pocket part 8, so as thereby to realize the telescopability of the profiled rail system 1.

The pocket part 8 is of two-part configuration and consists of an upper, first part 11 and a lower, second part 12. The first part 11 has a cover plate 13, which overlaps the web 9 and which is also visible in the assembled state of the profiled rail system 1. The second part 12 has a base plate 14, which underlaps the web 9 and which forms the lower portion of the pocket 10. On the base plate 14, upwardly directed, roughly vertical webs 15 are provided, which, with downwardly directed, roughly vertical webs 16, form stops for the web 9. In this way, the telescoping distance on both sides is limited.

In the second part 12, bores 17 are provided, which are passed through by screws 18. In order to obtain a flat structure of the profiled rail system 1 as a whole, flat head screws are preferably used as the screws 18.

In the first part 11, opposite the bores 17, a driving channel 19 is provided, into which the screws 18 can be driven. This driving channel 19 has the advantage over a threaded bore that it can be produced very easily by extrusion moulding methods. Moreover, the driving channel 19 allows the screws 18 to be fixed in any chosen position without the two parts 11, 12 having to be exactly aligned with each other.

Figure 2:
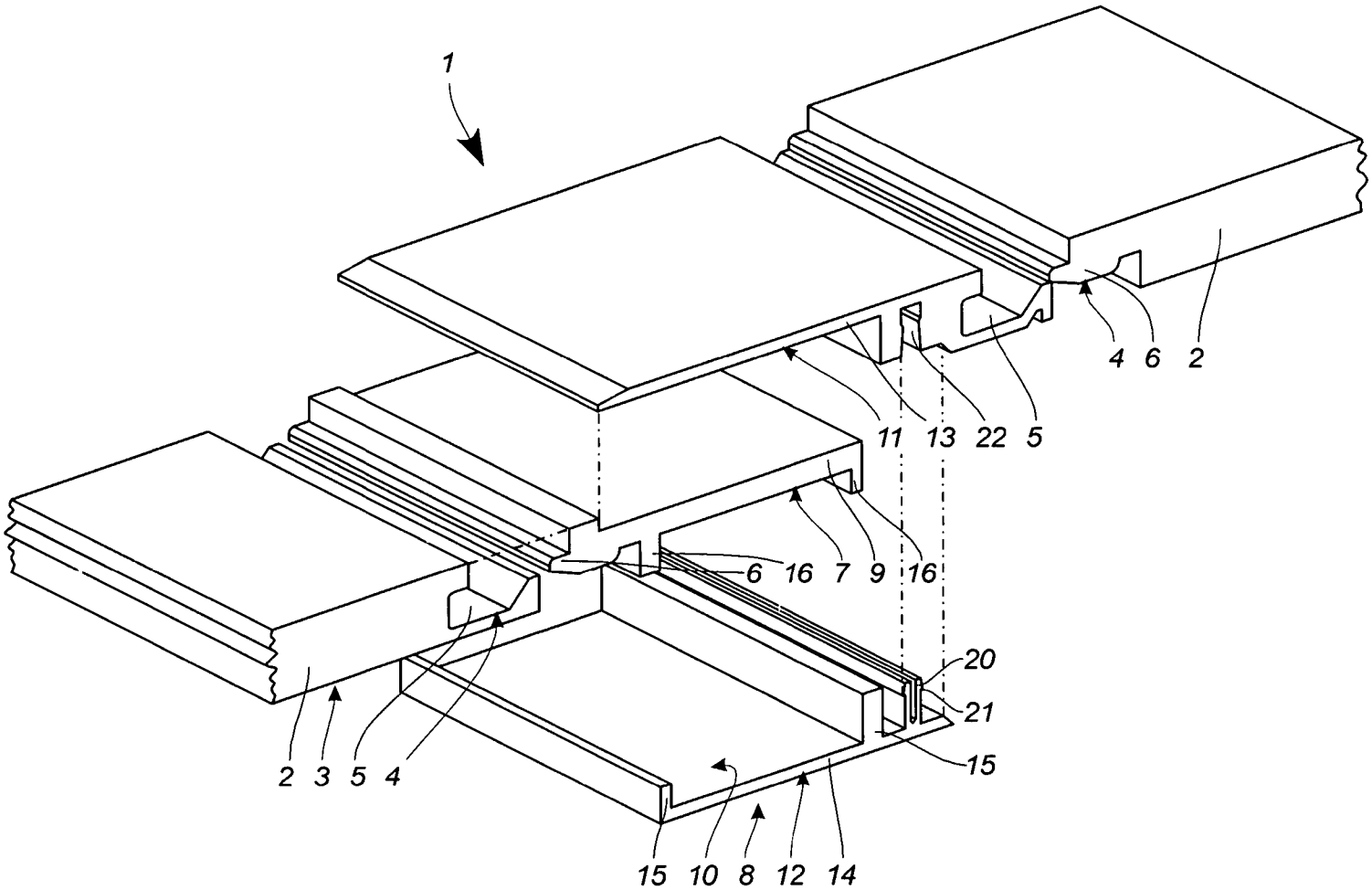
FIG. 2 shows a perspective exploded representation of a second embodiment of a profiled rail system.

FIG. 2 shows a second embodiment of the profiled rail system 1 according to FIG. 1, wherein the same reference symbols designate the same parts. Below, only the differences relative to the embodiment according to FIG. 1 are discussed.

For the fixing together of the parts 11, 12, in the embodiment according to FIG. 2 a screw connection is dispensed with. Instead, the second part 12 has two vertically upwardly directed webs 20, which are provided on the outside with respectively at least one undercut 21. The webs 20 engage in a likewise undercut receptacle 22 in the first part 11, which is configured to fit the webs 20.

For the assembly of the profiled rail system 1, the web part 7 is first placed into the pocket 10 of the second part 12. Then the first part 11 is pressed onto the second part 12 such that the webs 20 engage in the receptacle 22. When the parts 11, 12 are pressed together one against the other, the two webs 20 of the second part 12 are bent together, this deformation being realized in the elastic region. When the end position of the two parts 11, 12 relative to each other is reached, the web 15 of the second part 12 lies flat against the cover plate 13 of the first part 11. In this end position, the webs 20 slacken again and attain their shape represented in FIG. 2, in which they engage in locking manner into the undercut receptacle 22 of the second part 11.

Since some exemplary embodiments of the present invention are not shown or described, it must be understood that a multiplicity of changes and modifications of this exemplary embodiment described are possible, without departing from the essential idea and scope of protection of the invention defined by the claims.

LIST OF REFERENCE NUMERALS

1 profiled rail system
2 floor covering element
3 floor covering
4 tongue and groove profiling
5 groove
6 tongue
7 web part
8 pocket part
9 web
10 pocket
11 first part
12 second part
13 cover plate
14 base plate
15 web
16 web
17 bore
18 screw

19 driving channel
20 web
21 undercut
22 receptacle

The invention claimed is:

1. Profiled rail system for at least one of bridging expansion joints, cavities and as an edging of floor covering, wherein said profiled rail system has at least one web aligned substantially parallel to the floor covering, said at least one web displaceably engaging in a pocket formed by a cover plate overlapping said at least one web and a base plate underlapping said at least one web, said pocket being configured in at least two parts, a first part forming said cover plate and comprising at least one driving channel, and a second part forming said base plate and comprising a top surface facing said first part, a bottom surface facing away from said first part and a bore, said bore extending through said second part, wherein said first part and said second part are held together by holding means, said holding means comprising at least one screw having a head and a threaded shaft, said screw shaft penetrating said bore of said second part vertically from said bottom surface to said top surface and being received in said driving channel formed in said first part with said head abutting said second part and facing away from said top surface.

2. Profiled rail system according to claim 1, wherein the floor covering consists of floor covering elements, further comprising an undercut tongue and groove, wherein one of said undercut tongue and groove is located on said first part of said profiled rail system and the other of said undercut tongue and groove is located on one of the floor covering elements, wherein at least one of the floor covering elements and said first part can be joined together in a click-in manner as said undercut tongue and groove engage, by slight tilting and pressing of said tongue into said groove.

3. Profiled rail system according to claim 1, wherein said profiled rail system and the floor covering have top sides, said top sides lying flush with one another.

4. Profiled rail system according to claim 1, wherein the floor covering consists of floor covering elements, further comprising an undercut tongue and groove, wherein one of said undercut tongue and groove is located on said web of said profiled rail system and the other of said undercut tongue and groove is located on one of the floor covering elements, wherein at least one of the floor covering elements and said web can be joined together in a click-in manner as said undercut tongue and groove engage, by slight tilting and pressing of said tongue into said groove.

* * * * *